United States Patent [19]

Fittery

[11] 4,249,442

[45] Feb. 10, 1981

[54] ELEVATION SETTING MECHANISM FOR A TABLE SAW AND THE LIKE

[75] Inventor: Larry R. Fittery, Newmanstown, Pa.

[73] Assignee: Black & Decker Inc., Newark, Del.

[21] Appl. No.: 60,379

[22] Filed: Jul. 25, 1979

[51] Int. Cl.[3] ..... B27B 5/24

[52] U.S. Cl. ..... 83/473; 83/477.1; 83/477.2; 83/471.3; 144/130

[58] Field of Search ..... 83/473, 477.2, 477.1, 83/477; 144/133 R, 136 R, 130

[56] References Cited

U.S. PATENT DOCUMENTS

| | | | |
|---|---|---|---|
| 366,633 | 7/1887 | Mackintosii | 83/473 |
| 1,679,103 | 7/1928 | Thompson | 83/477.1 |
| 1,821,113 | 9/1931 | Neighbour | 83/473 |
| 2,530,290 | 11/1950 | Collins | 83/473 |
| 3,280,861 | 10/1966 | Gjerde | 83/473 |
| 3,386,482 | 6/1968 | Nadeau | 83/477.1 |

FOREIGN PATENT DOCUMENTS

| | | | |
|---|---|---|---|
| 211706 | 11/1957 | Australia | 83/477.2 |

*Primary Examiner*—Donald R. Schran

*Attorney, Agent, or Firm*—Leonard Bloom; Edward D. Murphy; Harold Weinstein

[57] ABSTRACT

There is disclosed an elevation setting mechanism for a motor-driven tool in a power tool apparatus such as a table saw. The table saw described includes a housing having a table top with an opening through which the motor-driven tool in the form of a saw blade can pass, and an assembly including a frame pivotally mounted in the housing about a first axis. Pivotally mounted in the frame about a second pivot axis is a first subassembly which includes the saw blade. Further, there is included a second subassembly pivotally mounted about the second pivot axis. The basic elevation setting mechanism includes a control lever operatively connected to the second subassembly for pivoting same, and means connecting the two subassemblies, such that they pivot in unison, in response to action of the control lever, for purposes of setting the tool at a coarse level. The mechanism further includes a second control mechanism operatively connected to the first subassembly for imparting additional pivotal movement thereto for effecting a vernier elevation adjustment of the saw blade. It is in this latter adjustable feature wherein the improvement of the invention lies. The invention is directed to a pivot nut pivotally mounted in the first subassembly, the pivot nut having a threaded opening perpendicular to its pivot axis in the first subassembly. A connecting rod includes a threaded end which is disposed and threadably engages a threaded opening in the pivot nut. Means are disclosed which restrain axial movement of the rod towards and away from the pivot axis of the pivot nut. When the connecting rod is rotated, the pivot nut is caused to translate with respect to the connecting rods and the pivotal mounting of the pivot nut converts the rotational movement of the rod into pivotal movement of the first sub-assembly about the second pivot axis whereby the further vernier elevation adjustment of the saw blade is effected.

14 Claims, 12 Drawing Figures

ELEVATION SETTING MECHANISM FOR A TABLE SAW AND THE LIKE

FIELD OF THE INVENTION

This invention relates generally to a power tool apparatus, such as a table saw and more particularly to an improved mechanism for setting the elevation of the tool for such an apparatus.

BACKGROUND OF THE INVENTION

In a copending patent application Ser. No. 31,271 entitled "Power Tool Apparatus and Method" filed on Apr. 18, 1979, and assigned to the present assignee, there is described a power tool apparatus which employs a rotatably mounted tool such as a saw blade for performing a variety of operations on wood, metal or the like. The apparatus disclosed therein provides a universal-type machine wherein the tool is easily and quickly adjusted for performing operations on a workpiece and wherein means are provided for accurately positioning the tool in relationship to the table top.

The accurate setting of the tool, referred to therein as the vernier adjustment feature, allows for precision cuts as might be needed for miter grooves, molding, shaping, dado cuts and the like.

The prior art described therein deals with a variety of devices employing for the most part only a coarse setting feature. One of the significant objects of that disclosure is to provide a vernier adjustment feature which is operable by the same hand used to set the coarse position of the blade. Towards that end, the application describes a leaf-spring arrangement wherein the leaf spring is disposed along the length of the control lever used to coarsely position the tool. Hub means are disposed at one end of the control lever and are secured to a corresponding end of the leaf spring. The remaining end of the leaf spring is secured to the assembly or subassembly which includes the tool. A knurled knob, concentric with the control lever is disclosed, upon which is disposed the hub to which the one end of the leaf spring is connected. By rotating the knurled knob, the hub is urged axially along the length of the control lever creating an appropriate force which is converted into pivotal movement of the subassembly including the tool such as a saw blade thus providing a vernier adjustment in elevation thereof.

Because of the employment of a leaf-spring to effect the vernier adjustment, there is no solid, structural integrity between the control lever and the subassembly containing the tool. During the cutting or other working operation, this could result in the set elevation not being maintained.

Further, it is conceivable that the leaf-spring in such an arrangement, could snap under certain circumstances.

It is therefore a primary object of this improvement to that basic power tool apparatus to provide means for accommodating the angular changes between the control lever and the assembly containing the tool which obviates the possibility of the set elevation not being maintained.

It is yet another object of this invention to provide an improved elevation setting mechanism which is likewise disposed in close proximity to the control lever so as to be manipulatable by the same hand used by the operator to set the coarse elevation position of the tool.

It is still another object of this invention to provide means for limiting the vernier adjustment of the tool to predetermined limits of elevation.

SUMMARY OF THE INVENTION

Towards the accomplishment of these and other objects, there is disclosed an improved elevation setting mechanism for a motor-driven tool in a power tool apparatus which includes a housing having a table top with an opening through which a tool can pass, and an assembly pivotally mounted in the housing, about a first pivot axis. The assembly includes a frame member, with a first and second subassembly pivotally mounted therein about a second pivot axis, the first subassembly including the tool such as a saw blade. The basic elevation setting mechanism includes a control lever operatively connected to the second subassembly for pivoting same, and means connecting the first to the second subassembly whereby the first subassembly pivots about the second pivot axis in unison with the pivoting of the second subassembly, such that the tool is raised or lowered in the opening to a desired coarse elevation with respect to the table top. The second subassembly further includes locking means for securing said second subassembly at a position corresponding to the desired coarse elevation setting of the tool.

The improvement to the mechanism according to the invention concerns the second control means operatively connected to the first subassembly for pivoting the first subassembly about the second pivot axis independently of the pivotal movement thereof due to its connection with the second subassembly, the second control means providing a further elevation adjustment of the tool. The improved second control means includes a pivot nut pivotally mounted to the first subassembly, the pivot nut having a threaded opening perpendicular to its pivot axis in the first subassembly. The improvement further includes a connecting rod having a threaded end disposed in the threaded opening of the pivot nut. Means are provided for restraining axial movement of the rod towards or away from the pivot axis of the pivot nut and, means are further provided for rotating the connecting rod such that the threaded end moves axially relative to the threaded opening, this action causes the first subassembly to pivot about the second pivot axis in response to the rotation of the connecting rod, such that vernier adjustment of the tool is effected.

The connecting rod is rotatably mounted to the control lever, effecting the operative connection between the control lever and the first subassembly.

The locking means for the control lever and the means for connecting the rod are proximately disposed in relation to the control lever, such that both are manipulatable by that same hand of the operator, without removing the hand from the lever throughout the complete elevation setting operation.

The first and second subassemblies include respective hub members for pivotally mounting the respective subassemblies on the second pivot axis. These hub members include cooperating key means for limiting the pivotal movement of the first assembly in response to the rotation of the connecting rod, thus limiting the vernier adjustment feature.

The invention can still further include means fixedly connected to the first subassembly which coact with the frame to limit the maximum, total elevation adjustment of the tool in order to prohibit contacting of the tool mounting means with the table top, particularly at large bevel angle settings.

DESCRIPTION OF THE PREFERRED EMBODIMENT

Figure 1:
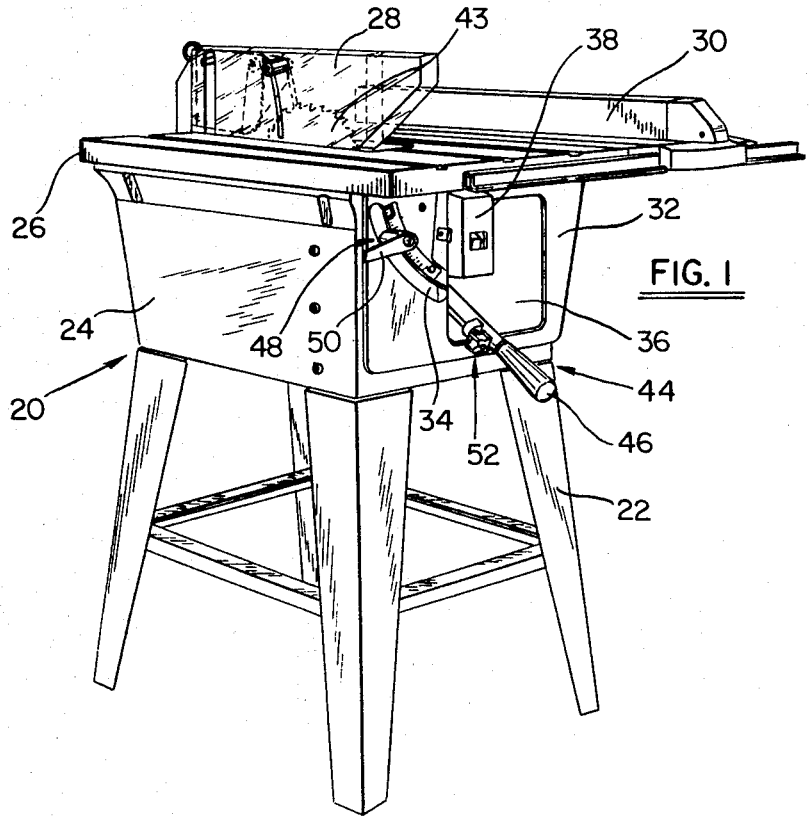
FIG. 1 is a perspective view of a table saw incorporating the improved elevation setting mechanism according to the invention for achieving a vernier adjustment of the elevation setting of the tool.

Referring now to FIG. 1, there is shown a power tool which employs the principles of the improved elevation setting mechanism described in the present invention. As with the copending application related generally to the same subject matter as set forth herein, although reference to a table saw tool will often times be made in this application, it is to be understood that the table saw version is but one species of the present invention which obviously, has broader application.

Again, as is the case in the copending application, the present invention would include a housing 20 having a stand 22, enclosure area 24, disposed upon the stand, and a table top section 26.

Further, the various accessories for such a power tool referred to in the aforementioned copending application would be employed herein. These include a guard and/or splitter member 28 and rip fence 30.

The enclosure 24 includes a front facing panel 32 with accommodating openings 34 and 36 .

The power control box 38 is connected to the tool drive means and a source of electric power in the necessary way.

The table top includes a suitably sized insert 40 having an opening 42 which is contoured to accommodate the particular rotating tool such as a circular sawblade 43.

Extending from within the enclosure 24 out through opening 36 is a control lever 44 which includes a rotatable hand grip 46 used, as described in the aforementioned copending application, to lock the control lever to the housing or frame within the enclosure 24 to thus set the desired coarse elevation of the tool.

Bevel angle setting means are depicted generally as including control lever 48 and a rotatable locking grip 50.

At 52, there is shown generally, a portion of the improved control means of the present invention. It will be described with particularity hereinafter.

Figure 2:
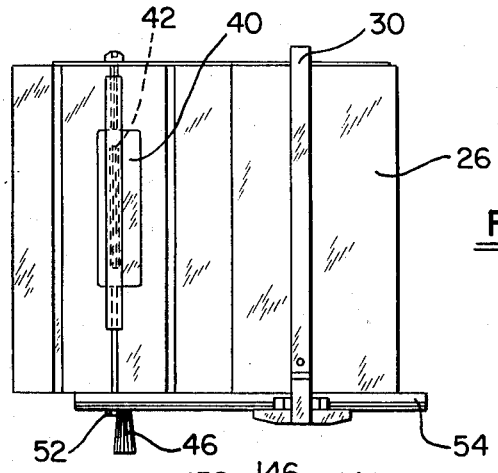
FIG. 2 is a plan view of the table top of the table saw depicted in FIG. 1.
Figures 3, 4, 5, 5A, 6, 7:
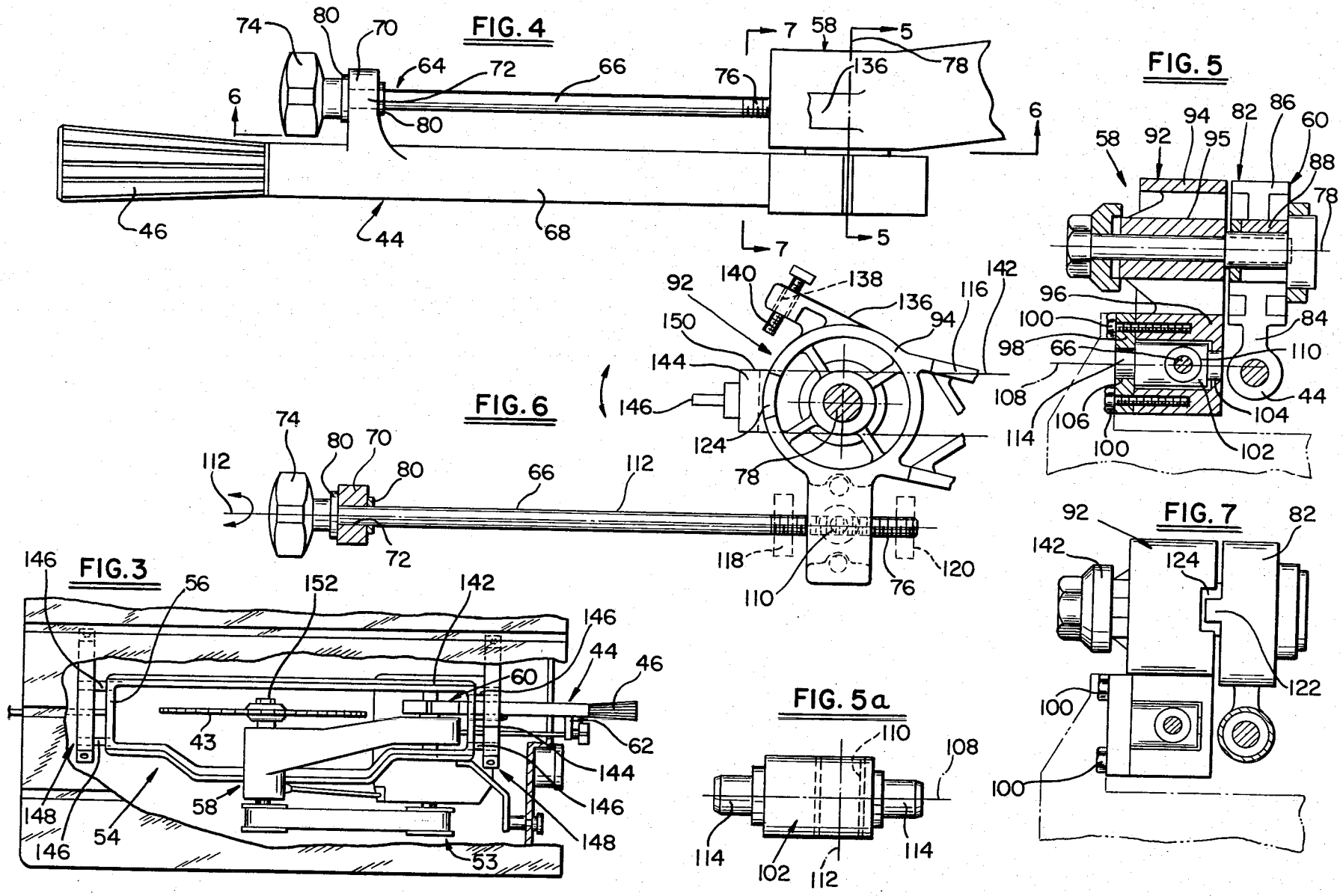
FIG. 3 is a partial plan view of the embodiment of FIG. 1 with a portion of the table top cut away to show the assembly within.
FIG. 4 is a plan view of the control lever and the control rod of elevation setting mechanism.
FIG. 5 is a sectional view taken along lines 5—5 of FIG. 4.
FIG. 5*a* is a detail view of the pivot nut of the improved elevation setting mechanism of the invention.
FIG. 6 is a side elevation view partially in section of the control lever of the invention taken along line 6—6 of FIG. 4.
FIG. 7 is an elevation view, taken along lines 7—7 in FIG. 4.

FIG. 2 is a plan view of the overall unit. FIG. 3, depicts the basic assembly and reference may be had to the copending application for a detailed description of the cooperating relationship between the parts. For purposes of understanding the claims as attached hereto, the drawing includes drive means for the tool 43. Assembly means 54 are pivotally mounted in the housing about a first pivot axis which, for the arrangement described in the copending application, is preferably in the plane of the table top and which is perpendicular to the plane of the rotational axis of the tool 43. The assembly means includes the frame 56. Pivotally mounted in the frame about a second pivot axis is a first subassembly 58 which includes the tool 43.

A second subassembly 60 is likewise pivotally mounted in the frame 56 about the second pivot axis.

The elevation setting mechanism includes the control lever 44 which is operatively connected to the second subassembly 60 and is generally as shown at 62. This operative connection enables pivoting of the first subassembly 58 about the second pivot axis in unison with the pivoting of the second subassembly 60 via the control lever 44. This pivoting action results in the raising or lowering of the tool in the opening 42 to a coarse elevation setting with respect to the table top, which may be sufficient for certain applications.

The second subassembly 60 including the control lever 44 further comprises locking means for securing the second subassembly 60 at the position corresponding to the desired coarse elevation. The locking means are made efficacious by the rotation of grip 46 in a manner described in the previously referenced copending application.

FIG. 4 is a plan view which shows close-up, the interrelationship of the operative connection between the control lever means 44 and the improved vernier control mechanism 64.

The latter mechanism 64 is seen to include a connecting rod 66 which is rotatably connected to the control lever 68 via flange 70. The latter includes a through bore 72 in which the rod 66 is mounted. Secured to the end of rod 66 is a knob 74 which is employed to rotate the rod in the mounting bore 72. The rod 66 includes a threaded end portion 76 which connects to and cooperates with a pivot nut in a manner to be described hereinafter.

The rod 66 is restrained in axial movement along its length, towards or away from the second pivot axis 78 of the subassemblies 58 and 60, by split washers 80 disposed in cooperating grooves in rod 66.

FIG. 4 reflects the fact that the knob 74 used to rotate the connecting rod 66 is proximately disposed relative to the handle grip 46. The operator uses the latter to both move the control lever 68 and to effect the locking operation as described in the aforementioned patent application. Thus all three operations, to wit, the coarse setting, locking, and vernier adjustment of the tool can be effected by the same hand without removing it from the lever 68 throughout the complete elevation setting operation.

Refer now to FIG. 5, which is taken along line 5—5 of FIG. 4. The particulars of the cooperative relationship between the control lever 44 and the first and second subassemblies, 58 and 60, respectively are disclosed. Control lever 44 is seen to be connected directly to hub 82 of the second assembly 60 through flange 84. The hub includes an outer concentric section 86 and a split concentric, inner section 88 which cooperates with other elements of the locking mechanism, as described in the copending application, to secure the control lever 44 to the frame 56. Hub 82 of the subassembly 60 pivots about second pivot axis 78.

The first subassembly 58 includes a hub portion 92 which is likewise pivotally mounted about axis 78. It includes an outer concentric section 94 and inner concentric section 95. Extending radially downward as viewed in FIG. 5, is a flange 96. To this is secured the motor drive means for the tool 43 and the second control means, providing the further elevation adjustment of said tool. The motor is secured to the flange 96 via motor support bracket 98 which is fastened to the flange by screws 100.

During the assembly of the unit, one end of a pivot nut 102 is disposed in a pivot hole mounting 104. The motor support bracket 98 includes a pivot hole mounting 106 which receives the cooperating end of the pivot nut 102 therein. Mounting holes 104 and 106 are aligned and define a pivot axis 108 for the pivot nut.

FIG. 5*a* is a detail of the pivot nut 102. It shows that the unit includes a threaded cylindrical opening 110, the axis for which 112 is at right angles to the pivot axis 108. Mounting pins 114 are dimensioned so as to be dispaseable in the pivot nut support holes 104 and 106.

Referring now to FIG. 6, the section taken along 6—6 of FIG. 4, the effect of rotating the connecting rod 66 about its longitudinal axis 112 can be best appreciated. The threaded end 76 of the rod 66 is disposed in threaded opening 110 of the pivot nut. The rod 66 is restrained in axial movement along axis 112 towards or away from the pivot axis 108 of the pivot nut by split washers 80 disposed in grooves on the rod 66, on either side of flange 70. It will be recalled that flange 70 is a radial extension of control lever 66 of the coarse control means 44. Viewing the rotation of the control lever 66 along the axis 112 from the knob end of the rod, clockwose movement of the rod would cause it to advance towards the threaded opening if the rod were not restrained. Since, however, it is restrained the pivot nut 102 must move, and for the clockwise rotation indicated would move back along the length of the rod 66 in the direction of the knob. This axial movement of the pivot nut 102 along the rod 66 results in pivotal movement of the pivot nut 102 about its pivot or mounting axis 108 and a rotational pivot movement of the first subassembly 58 in a clockwise fashion, as viewed in FIG. 6, about the second pivot axis 78. It can be seen that this results in movement of the tool 43 support arm 116, in a downward direction.

Counterclockwise rotation of the connecting rod 66, again as viewed from the knob end of the rod towards the threaded end, results in relative movement of the pivot nut 102 away from the knob 74 along axis 112. The translation of pivot nut 102 causes the motor support bracket 98 to rotate relative thereto causing a counterclockwise movement of the first subassembly 58 about pivot axis 78. The tool supporting arm 116 is thereby raised which, in turn, raises the tool 43 in the table top opening 42.

From a practical point of view, particularly with regard to the size of the cutout section 36 on the front panel 32 of the enclosure, it has been determined that it is desirable to limit the adjustment achieved by this vernier technique. One approach is to include nuts 118 and 120 on the threaded end 76 of the connecting rod 66. Nut 118 would limit relative axial movement of pivot nut 102 in the direction towards knob 74, while nut 120 would limit axial movement in the opposite direction.

Alternatively, a less costlier technique for limiting such movement is shown in FIG. 7. As shown outer concentric section of hub 82 is seen to include an axially extending tab 122. Cooperating with this tab, and disposed in outer concentric section of hub 92 is a corresponding detent or cut out 124. The arcuate length of tab 122 typically, might describe a rotational angle of perhaps 20°. The similar angle defined by the cutout 124 typically is on the order of 32°. This allows for a relative pivotal movement between the two hub sections 82 and 92 of approximately 12°. Based on a typical geometry for particularly a typical length of tool supporting arm 116, a relative pivotal movement of 12° would result in a vernier blade adjustment of approximately 1.0 inch.

Figure 8:
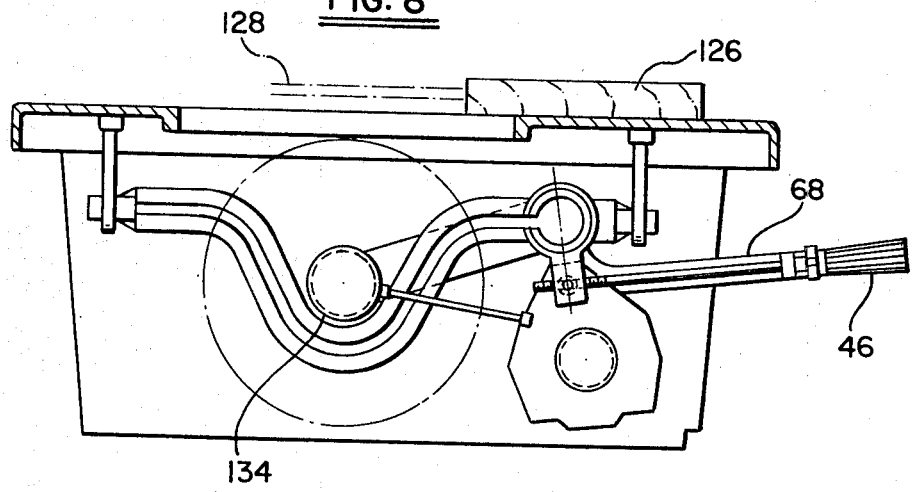
FIG. 8 is a schematic, side elevation view of the embodiment of the invention showing the tool assembly in its fully down position.
Figure 9:
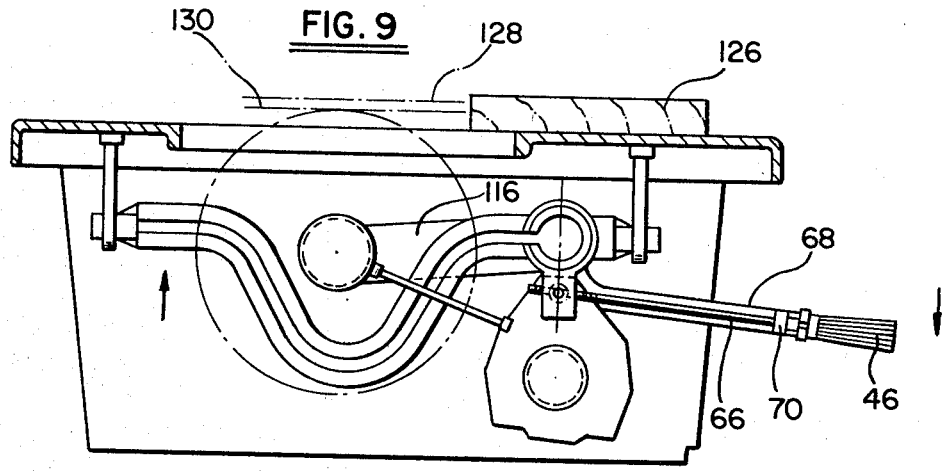
FIG. 9 is a schematic, side elevation view of the described embodiment of the invention showing the tool assembly in a coarse position relative to the workpiece.
Figure 10:
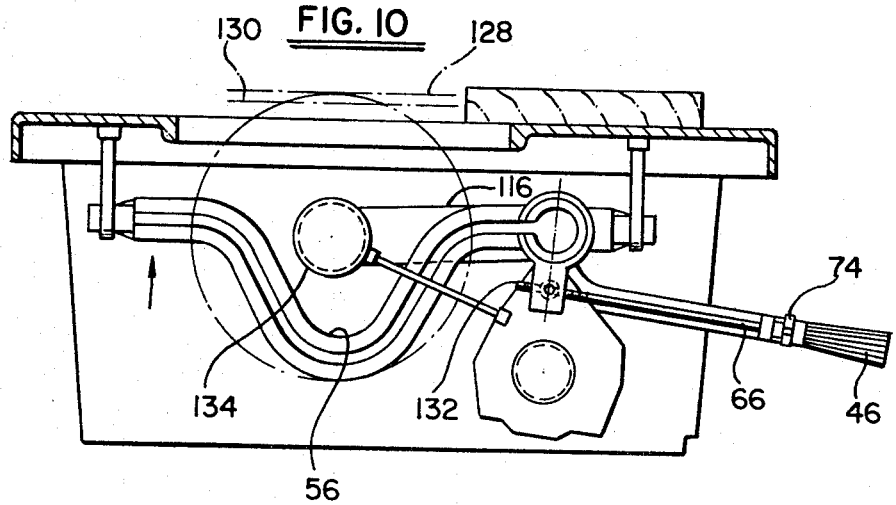
FIG. 10 is a schematic, side elevation view of the embodiment of the invention showing the effect of the improved vernier adjustment mechanism as described by the present invention.

FIGS. 8, 9 and 10 show the sequence of steps which are employed when using the improved mechanism described herein to its fullest capacity. FIG. 8 shows the power tool apparatus with the tool in its fully down position. In this position, the high point of the particular tool is positioned below the top surface of the table top. Work piece 126 is positioned on the table top.

Presume for the following purposes, that it is desired to cut a groove in the workpiece 126 to a depth as defined by level 128. The operator grasps the control lever 68 via grip 46. If the unit had been previously locked, the operator first releases that mechanism by rotating the grip. Having released the mechanism, the operator pushes downward on the lever 68 as viewed in FIG. 9. Through the operative connection effected by the mounting of rod 66 in flange 70, downward movement of the control lever 68 causes clockwise, rotational movement of the tool supporting arm 116 as viewed in FIG. 9. This results in upward movement, again as viewed in FIG. 9, of the tool. An arbitrary coarse level 130 is reached and the operator then locks the control lever 68 to the pivoting hub as described in the above-identified copending application.

Having locked the control lever at the position corresponding to the coarse level 130, the operator then manipulates knob 74, by rotating same, to effect the additional adjustment necessary to achieve the desired elevation level 128. For the arrangement decribed with respect to FIG. 6, by rotating the rod 66 via the knob 74, counterclockwise as viewed along the length of that rod from the knob end, the pivot nut is urged to move towards the end of the rod 132. This results in additional clockwise rotation of the tool piece supporting arm 116. When the desired level 128 is reached, the power to the tool drive means can be activated and the appropriate cut or other working operation performed.

As a safety precaution, at the end of the particular working operation, the locking mechanism is released with the weight of the tool and support arm and the counterlever effect achieved about axis 78 resulting in the tool dropping below the top surface of the table top. The tool mounting hub 134 bottoms on the apex of the supporting frame 56. The geometry of the cooperating members relative to the under side of the table top, is such as to insure that the tool is completely below the top surface of the table.

Referring again to FIGS. 3 and 6, the outer concentric section 94 of hub 92 is seen to further include a tangential flange extension 136. This includes a threaded opening 138 for accepting a positioning bolt 140. The length of bolt extending down and beyond the threaded opening is preset, based on the discussion which follows.

Pivotally mounted in side wall 142 of frame 56, are hubs 82 and 92. Transverse to side wall 142 is end section 144 which includes frame mounting pins 146. The latter are positioned in mount 148 (see FIG. 11) and support the frame for its bevel angle movement.

Figure 11:
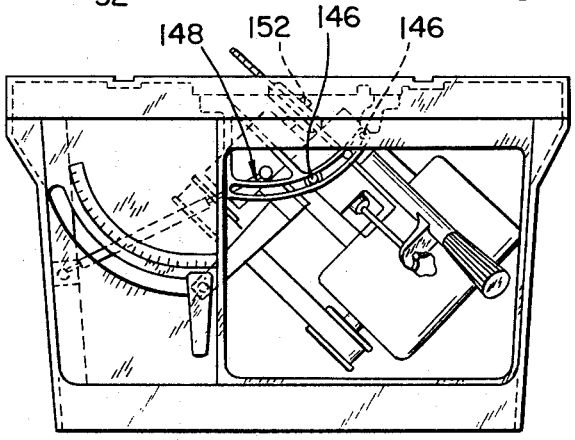
FIG. 11 is an end elevation view of the embodiment of FIG. 1 with the end panel removed to show the assembly within.

FIG. 11 depicts the assembly 54 set at a maximum bevel angle. For this setting and referring to FIG. 6, the length of the bolt 140 extending downward beyond the threaded opening 138 is adjusted. The length is selected such that the end of the bolt will contact the top surface 150 of transverse end section 144 of supporting frame 56 to restrict the allowable upward movement of the tool supporting arm 116, such that the arbor shaft mounted nut 152 is just prohibited from contacting the plate insert, 40 (see FIG. 2).

What is claimed is:

1. In an elevation setting mechanism for a motor-driven tool in a power tool apparatus which comprises a housing including a tabletop having an opening through which the tool can pass, and assembly means pivotally mounted in the housing and which includes the tool, the mechanism including first control means having a control lever operatively connected to the assembly means for pivoting same, whereby the tool is raised or lowered in the opening to a desired elevation with respect to the tabletop in a quick and coarse setting manner, and locking means for securing the control lever to the housing at a position corresponding to the desired coarse elevation setting for the tool and second control means operatively connected to the assembly means for pivoting the assembly means independently of the control lever, the second control means providing a further elevation adjustment of the tool, the improvement to the second control means comprising:

a pivot nut pivotably mounted to the assembly means, said pivot nut having a threaded opening at transverse to its pivot axis in the assembly means;

a connecting rod having a threaded end disposed in said threaded opening;

means for restraining axial movement of said rod towards or away from the pivot axis of said pivot nut; and means for rotating said connecting rod such that said threaded end moves axially in said threaded opening, whereby the assembly means pivots about its pivotal mounting in the housing in response to the rotation of said connecting rod, to provide the further elevation adjustment of the tool.

2. In an elevation setting mechanism for a motor-driven tool in a power tool apparatus which comprises a housing including a tabletop having an opening through which the tool can pass, assembly means pivotally mounted in the housing about an axis parallel to the working axis of the tool the assembly means including frame means and subassembly means pivotally mounted in the frame means and which include the tool the mechanism including first control means having a control lever operatively connected to the subassembly means for pivoting same, whereby the tool is raised or lowered in the opening to a desired elevation with respect to the tabletop in a quick and coarse setting manner, and locking means for securing the control lever to the frame means at a position corresponding to the desired coarse elevation setting for the tool, and second control means operatively connected to the subassembly means for pivoting the subassembly means independently of said control lever, said second control means providing a further elevation adjustment of the tool, the improvement to the second control means comprising:

a pivot nut pivotally mounted to the subassembly means, said pivot nut having a threaded opening at right angles to its pivot axis in the subassembly means;

a connecting rod having a threaded end disposed in said threaded opening;

means for restraining axial movement of said rod towards or away from the pivot axis of said pivot nut; and means for rotating said connecting rod such that said threaded end moves axially in said threaded opening, whereby the subassembly means rotates about its pivotal mounting in the frame means in response to the rotation of said connecting rod, to provide the further elevation adjustment of the tool.

3. In an elevation setting mechanism for a motor-driven tool in a power tool apparatus which comprises a housing including a tabletop having an opening through which the tool can pass, a first subassembly which includes the tool, pivotally mounted in the housing about a pivot axis, a second subassembly pivotally mounted in the housing, about said pivot axis, the mechanism including a control lever operatively connected to the second subassembly for pivoting same, about said pivot axis and means connecting the first subassembly to the second subassembly, whereby the first and second subassemblies pivot about the said pivot axis in unison such that the tool is raised or lowered in the opening to a desired elevation with respect to the tabletop, in a quick and coarse setting manner, the second subassembly further including locking means for securing the second subassembly at a position corresponding to the desired coarse elevation setting for the tool and second control means operatively connected to the first subassembly for pivoting the first subassembly about said pivot axis independently of the rotational movement thereof due to its connection with the second subassembly, said second control means providing a further elevation adjustment of the tool, the improvement to the second control means comprising:

a pivot nut pivotally mounted to the first subassembly, said pivot nut having a threaded opening at right angles to its pivot axis in the first subassembly;

a connecting rod having a threaded end disposed in said threaded opening;

means for restraining axial movement of said rod towards or away from the pivot axis of said pivot nut; and means for rotating said connecting rod such that said threaded end moves axially in said threaded opening, whereby the first subassembly means pivots about said first mentioned pivot axis in response to the rotation of said connecting rod, to provide the further elevation adjustment of the tool.

4. In an elevation setting mechanism for a motor-driven tool in a power tool apparatus which comprises a housing including a tabletop having an opening through which the tool can pass, assembly means pivotally mounted in the housing about a first axis the assembly means including frame means, a first subassembly including the tool pivotally mounted in the frame means about a second pivot axis, a second subassembly pivotally mounted about the second pivot axis, the mechanism including a control lever operatively connected to the second subassembly for pivoting same, about said second pivot axis and means connecting the first subassembly to the second subassembly, whereby the first subassembly pivots about the second pivot axis in unison with the second subassembly, such that the tool is raised or lowered in the opening to a desired elevation with respect to the tabletop, in a quick and coarse setting manner, the second subassembly further including locking means for securing the second subassembly at a position corresponding to the desired coarse elevation setting for the tool, and second control means operatively connected to the first subassembly for pivoting the first subassembly about the second pivot axis independently of the pivotal movement thereof due to its connection with the second subassembly, said second control means providing a further elevation adjustment of the tool, the improvement to the second control means comprising:

a pivot nut pivotally mounted to the first subassembly, said pivot nut having a threaded opening perpendicular to its pivot axis in the first subassembly;

a connecting rod having a threaded end disposed in said threaded opening;

means for restraining axial movement of said rod towards or away from the pivot axis of said pivot nut; and means for rotating said connecting rod such that said threaded end moves axially in said threaded opening, whereby the first subassembly pivots about the second pivot axis in response to the rotation of said connecting rod, to provide the further elevation adjustment of the tool.

5. The improved elevation setting mechanism claimed in either one of claims 1 through 4 inclusive, wherein said connecting rod includes means at the threaded end thereof for limiting the axial movement of said threaded end in said threaded opening, whereby the further elevation adjustment is limited.

6. In an elevation setting mechanism for a motor-driven tool in a power tool apparatus which comprises a housing including a tabletop having an opening through which the tool can pass, assembly means pivotally mounted in the housing about a first pivot axis the assembly means including frame means, a first subassembly including the tool pivotally mounted in the frame means about a second pivot axis, a second subassembly pivotally mounted about the second pivot axis, the mechanism including a control lever operatively connected to the second subassembly for pivoting the same, about said second pivot axis and means connecting the first subassembly to the second subassembly, whereby the first subassembly pivots about the first pivot axis in unison with the second subassembly, such that the tool is raised or lowered in the opening to a desired elevation with respect to the tabletop, in a quick and coarse setting manner, the second subassembly further including locking means for securing the second subassembly at a position corresponding to the desired coarse elevation setting for the tool and second control means operatively connected to the first subassembly for pivoting the first subassembly about the second pivot axis independently of the rotational movement thereof due to its connection with the second subassembly, said second control means providing a further elevation adjustment of the tool the improvement to the second control means comprising:

a pivot nut pivotally mounted to the first subassembly, said pivot nut having a threaded opening perpendicular to its pivot axis in the first subassembly;

a connecting rod having a threaded end disposed in said threaded opening;

means for restraining axial movement of said rod towards or away from the pivot axis of said pivot nut; and means for rotating said connecting rod such that said threaded end moves axially in said threaded opening, whereby the first subassembly pivots about the second pivot axis in response to the rotation of said connecting rod, to provide the further elevation adjustment of the tool, said connecting rod rotatably connected to the control lever whereby the operative connection between the control lever and the first subassembly is effected, said first and second subassemblies including respective hub members, whereby said subassemblies are pivotally mounted on the second pivot axis said hub means including cooperating key means for limiting the rotational movement of said first subassembly in response to the rotation of said connecting rod and therefore, limiting the further elevation adjustment of the tool.

7. The improved elevation setting mechanism claimed in either one of claims 1 through 4 inclusive, or 6, wherein the means for rotating said connecting rod are proximately disposed to the control lever such that said rod rotating means are manipulatable by the same hand of the operator used to move the control lever to set the coarse elevation of the tool, without removing the hand from said lever throughout the complete elevation setting operation.

8. The improved elevation setting mechanism claimed in either one of claims 1 through 4 inclusive, or 6, wherein the locking means and said means for rotating said connecting rod are proximately disposed to the control lever such that both are manipulatable by the same hand of the operator used to move the control lever to set the coarse elevation of the tool, without removing the hand from said lever throughout the complete elevation setting operation.

9. The improved mechanism claimed in either one of claims 1 through 4 inclusive wherein said connecting rod is rotatably connected to the control lever whereby the operative connection between the control lever and the respective assembly means or subassembly is formed.

10. The improved mechanism claimed in claims 3 or 4 wherein said first and second subassemblies include respective hub members, whereby said subassemblies are pivotally mounted in the housing or frame means respectively, said hub means including cooperating key means for limiting the pivotal movement of said first subassembly in response to the rotation of said connecting rod and, therefore, limiting the further elevation adjustment of the tool.

11. The improved mechanism claimed in either claim 4 or 6, wherein the first subassembly further includes means for mounting the tool thereto, and means fixedly connected to the first subassembly, said latter means coacting with the frame means to limit the maximum, total elevation adjustment of the tool whereby the contacting of said means for mounting of the tool with the tabletop is prevented for larger bevel angle settings.

12. The improved mechanism claimed in either claims 4 or 6 wherein the weight of the first subassembly is distributed relative to the second pivot axis, whereby the first subassembly rotates down from the table top of its own accord when said locking means is released, the cooperating shares of the frame means and the first subassembly being such, that the first subassembly is allowed to rotate downward until the tool is completely below the top surface of the table top.

13. In an elevation setting mechanism for a saw blade in a table saw which comprises a housing including a tabletop having an opening through which the saw blade can pass, drive means for the saw blade and assembly means pivotally mounted in the housing and which includes the saw blade, the mechanism including first control means having a control lever operatively connected to the assembly means for pivoting same, whereby the saw blade is raised or lowered in the opening to a desired elevation with respect to the tabletop in a quick and coarse setting manner, and locking means for securing the control lever to the housing at a position corresponding to the desired coarse elevation setting for the saw blade, and second control means operatively connected to the assembly means for pivoting the assembly means independently of the control lever, the second control means providing a vernier elevation adjustment of the saw blade, the improvement to the second control means comprising:

a pivot nut pivotally mounted to the assembly means, said pivot nut having a threaded opening transverse to its axis of rotation in the assembly means;

a connecting rod having a threaded end disposed in said threaded opening;

means for restraining axial movement of said rod towards or away from the pivot axis of said pivot nut; and means for rotating said connecting rod such that said threaded end moves axially in said threaded opening, whereby the assembly means pivots about its pivoted mounting in the housing in response to the rotation of said connecting rod, to provide the vernier elevation adjustment of the saw blade.

14. The improved mechanism of claim 13, wherein said connecting rod is rotatably connected to the control lever whereby the operative connection between the control lever and the assembly means is formed.

* * * * *